United States Patent [19]

Heck

[11] 4,376,082

[45] Mar. 8, 1983

[54] INSULATIVE CAP FOR EVAPORATIVE COOLER

[76] Inventor: Robert M. Heck, 7418 S. 42nd St., Phoenix, Ariz. 85040

[21] Appl. No.: 295,847

[22] Filed: Aug. 24, 1981

[51] Int. Cl.[3] ..... B01F 3/04

[52] U.S. Cl. ..... 261/127; 261/29; 261/DIG. 43; 62/DIG. 13; 62/DIG. 16; 62/259.4; 165/135; 312/100

[58] Field of Search ..... 261/29, 127, 30, DIG. 4, 261/DIG. 3, DIG. 46, 95, 97, 99, 103, 104, DIG. 43; 62/DIG. 13, DIG. 16, 507, 259.4, 259.1; 165/135; 312/100, 102

[56] References Cited

U.S. PATENT DOCUMENTS

| | | | |
|---|---|---|---|
| 1,951,270 | 3/1934 | Bradburn | 261/DIG. 4 |
| 1,951,962 | 3/1934 | Baum | 261/29 |
| 2,364,154 | 12/1944 | Markley, Jr. | 62/507 |
| 2,432,042 | 12/1947 | Richard | 62/DIG. 13 |
| 2,725,729 | 12/1955 | Mills | 261/29 |
| 2,740,378 | 4/1956 | Duncan | 62/526 |
| 2,783,065 | 2/1957 | Martin | 62/DIG. 13 |
| 2,970,454 | 2/1961 | Rice | 261/DIG. 4 |
| 3,290,020 | 12/1966 | Finnley | 261/29 |
| 3,294,376 | 12/1966 | Eranosian | 261/29 |
| 3,379,481 | 4/1968 | Fisher | 312/100 |
| 4,003,610 | 1/1977 | Main | 312/100 |
| 4,309,365 | 1/1982 | Van Ness et al. | 62/DIG. 16 |

FOREIGN PATENT DOCUMENTS

| | | | |
|---|---|---|---|
| 795873 | 6/1958 | United Kingdom | 312/100 |

*Primary Examiner*—Tim R. Miles
*Attorney, Agent, or Firm*—James F. Duffy

[57] ABSTRACT

A shield to protect the exposed surface of the casing of an evaporative cooler from the heat loading effects of the environment is comprised of thermal insulation means coupled to the exposed surface of the cooler casing and a weather protective covering coupled to both the insulative means and the casing of the cooler so as to protect the thermal insulation means from the environment and maintain the invention in place, covering and protecting the selected surface of the cooling casing to be protected. In the embodiment disclosed, the surface selected for protection is the top surface of an evaporative cooler and the insulation material may be comprised of a polyfoam insulative board configured to conform to the top surface of the cooler. A protective covering is set down over the insulative board and affixed mechanically to the casing to prevent the cover from being inadvertently dislodged. The invention is especially adapted to be retrofit to existing evaporative cooler installations.

10 Claims, 2 Drawing Figures

INSULATIVE CAP FOR EVAPORATIVE COOLER

BACKGROUND

1. Field of the Invention

The invention relates to improvements in evaporative cooling devices.

The invention particularly relates to means for reducing the internal temperature of evaporative cooler devices.

The invention specifically relates to an insulative cap for protecting an exposed surface of an evaporative cooler device from the heat loading effects of the environment.

2. Prior Art

In arid regions such as found in the desert southwestern sections of the United States extending from California to Texas, evaporative coolers provide a substantial amount of the air conditioning devices in use. An evaporative cooler device generally comprises a vented casing into which air from the exterior is drawn through water saturated pads. In passing through the saturated pads, the air causes the evaporation of water and in so doing its relative humidity is raised at the same time as its temperature is lowered. This cool air is then passed from the interior of the casing to the space to be air conditioned.

Most such evaporative coolers lie fully exposed to the heat loading effects of the sun. This raises the temperature of the casing and of the air at the interior of the evaporative cooler casing. Such head-load induced temperature-rises within the casing offsets to a significant degree the evaporative cooling effect of the air passing through the saturated pads. To offset the heat loading effect, many evaporative cooler installations are enclosed within sun-shielding enclosures which shade the exposed casing.

Because evaporative cooling is such an effective and economical cooling method to employ within arid regions, many homeowners choose to provide the bulk of their home cooling by evaporative cooling devices. Most frequently such evaporative home cooling devices for use in family residences are emplaced atop the roofs of homes employing these devices. The homeowner is thus concerned with the appearance of such roof-mounted devices. Typically, sun-shielding enclosures have been considered an eyesore by homeowners and a detriment to property values.

It is an objective of the invention to provide means for shielding an evaporative cooler from the detrimental effects of environmental heat loading.

It is a further objective of the invention to provide a heat-loading shield for an evaporative cooler which will not detract from the appearance of such a cooler.

It is a specific objective of the invention to provide an insulative cap for shielding the exposed surface of an evaporative cooler from the heat loading effects of the environment.

It is a further specific objective of the invention that such a heat-shielding cap aid in reflecting the sun's heat from the shielded surface of the evaporative cooler.

It is a particular objective of the invention that a heat-load shielding cap be provided which may be readily retrofitted to existing evaporative cooler installations.

SUMMARY OF THE INVENTION

The invention represents an improvement in an evaporative cooler device which has an outer casing with a surface exposed to the heat loading effects of the environment. Thermal insulation means are coupled to that exposed surface so as to insulate it from the temperature effects of such exposure and weather protection means are coupled to both the thermal insulation means and to the outer casing so as to protect the thermal insulation from the environment. In the embodiment disclosed, the weather protection means comprises a water impervious barrier or at least a water resistant barrier. In a preferred embodiment, the weather protection means comprises a cap configured to enclose both the insulation means and the top surface of the casing. Means are also provided to couple the cap means to the casing in such a manner that it will not be readily dislodged by inadvertence or by high winds. The weather barrier cap may comprise a moldable plastic material. Further, the cap is disclosed as having at least one heat reflective surface to reduce heat loading from exposure to the sun. The material of which the weather protection cap is fabricated is suggested as being one of low thermal conductivity. In practice, it is well to configure both the insulation means and the weather protective cap to the confirmation of the exposed surface of the casing so that ease of installation will be enhanced. Significant reduction of cooling air flow temperatures can be achieved when the invention is provided atop the exposed top surface of the evaporative cooling case.

DETAILED DESCRIPTION OF THE INVENTION

When the casing of an evaporative cooler is exposed to the heat loading effects of the environment, the interior temperature rises which in turn produces two detrimental effects. The air which is cooled by the evaporative action of its passage through saturated pads is raised in temperature because of the heat-loaded interior of the cooler casing. The increased temperature within the casing is also detrimental, to a somewhat lesser extent, to the lifetime of the fan motor employed in drawing air into the evaporative cooler through the saturated pads. Both of these detrimental effects may be alleviated by reducing the temperature interior to the casing of the evaporative cooler.

Figure 1:
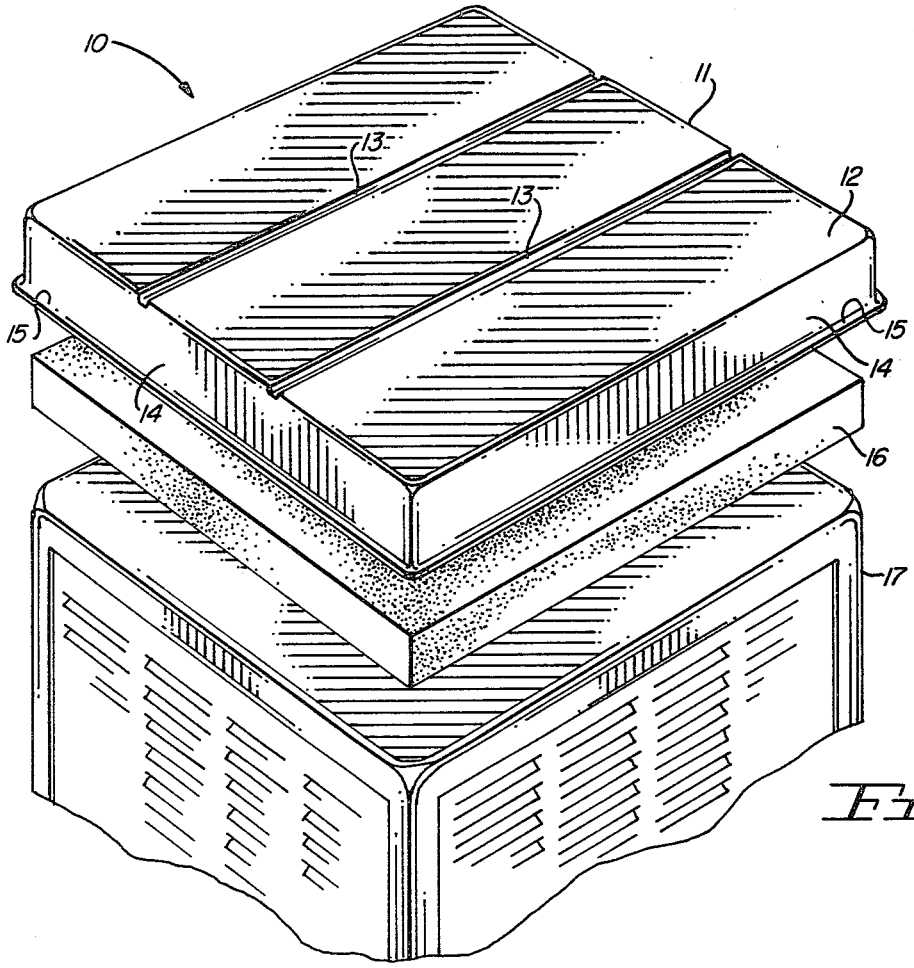
FIG. 1 is an exploded perspective view illustrating the manner in which the cooler cap is emplaced atop an existing evaporative cooler installation.

FIG. 1 is an exploded perspective view of the invention, to be known commercially as COOLER CAP, 10. The COOLER CAP insulative protective device 10 comprises a cover cap 11 having a surface 12 with reinforcing ribs 13. Surface 12 may be utilized as a heat reflective surface by fabricating it of a light-colored material.

Cover cap 11 is further comprised of side surfaces 14 which couple top surface 12 to a reinforcing lip, or flange, 15 which is peripheral to cover cap 11.

Insulative material 16, for example glass fiber material or a polyfoam sheet, is emplaced within cover cap 11. Insulation material 16 will be emplaced between the exposed surface of the casing of an evaporative cooler device and the underside of surface 12 when cover cap 11 is installed on the evaporative cooler. This arrangement is illustrated in FIG. 1 showing the manner in which the invention is installed on an existing evaporative cooler 17.

Figure 2:
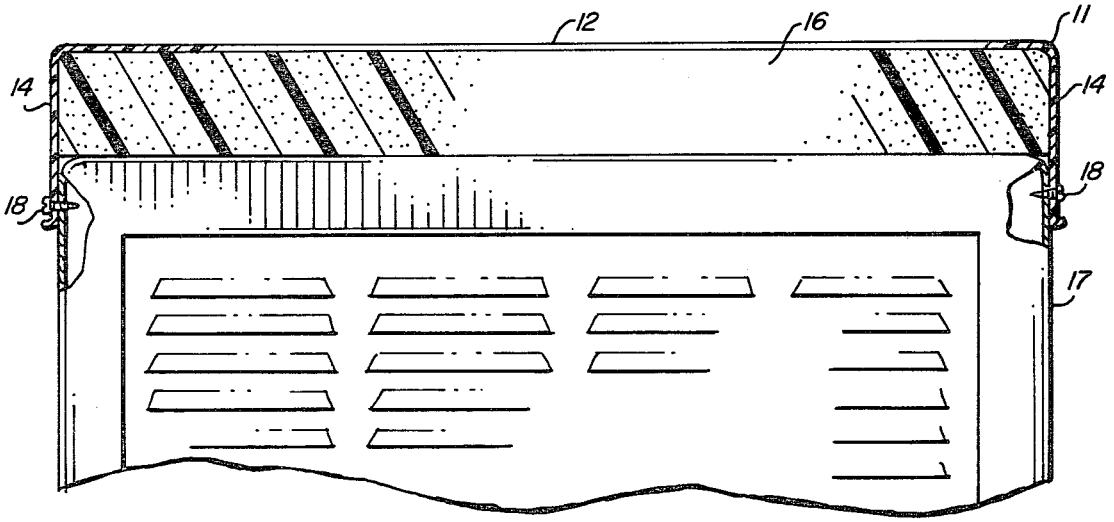
FIG. 2 is a cross-sectional view of the cooler cap in place on an evaporative cooler.

It is assumed that the top surface of evaporative cooler 17 is the exposed surface chosen to be protected by use of the invention. Insulative material 16 is configured to conform to the exposed top surface of the casing of evaporative cooler 17. Cover cap 11 is then set down atop the insulative material 16 as indicated in the cross-sectional view of FIG. 2. With the invention so emplaced, means for coupling cover cap 11 to the casing of cooler 17 may be provided, for example screw threaded fasteners 18 which fasten cover cap 11 to the casing of cooler 17. With cover cap 11 and insulative material 16 in place, the top of the casing of cooler 17 is no longer exposed to the heat loading effects of the environment. In actual use, the temperature of the air flowing to the air conditioned area serviced by evaporative cooler 17 was found to experience a temperature reduction of 3°–4° F. when COOLER CAP 10 was emplaced atop an evaporative cooler in the manner indicated in the figures.

The ability of insulative material 16 to protect the evaporative cooler 17 from the heat load of the environment will be enhanced by fabricating cover cap 11 of a light-colored, non-thermal conductive material. As an example, a white plastic material may be utilized. The use of such material lends itself to commercially efficient molding techniques of production.

While those skilled in the art will readily appreciate the ease with which the invention may be adapted to the top surface of the casing of an existing evaporative cooler installation, such skilled persons will also readily recognize that insulative material and weather protection covering means, resistant or impervious to water, may be configured so as to readily conform to other exposed surface features of existing evaporative cooler installations.

Those skilled in the art will readily be able to conceive of other embodiments of the invention based on the teachings herein. To the extent that such other embodiments are drawn from these teachings, it is intended that such embodiments shall fall within the ambit of protection of the claims which follow hereinafter.

Having described my invention in the foregoing specification and accompanying drawings in such a clear and concise manner that those skilled in the art may readily understand and simply practice the invention, that which I claim is:

1. In an evaporative cooler comprising an outer casing with a surface exposed to the heat loading effects of the environment, the improvement comprising:

thermal insulation means coupled to said exposed surface of said outer casing of said evaporative cooler for insulating same from the temperature effects of exposure to sunlight and a heated environment; and weather protection means coupled to both said thermal insulation means and said outer casing for protecting said thermal insulation means from the environment.

2. The improvement of claim 1 wherein said weather protection means further comprises at least one of a water impervious barrier and a water resistant barrier.

3. The improvement of claim 2 wherein said weather protection means further comprises at least one heat reflective surface.

4. The improvement of claim 2 wherein said weather protection means further comprises a material of low thermal conductivity.

5. The improvement of claim 1 wherein said thermal insulation means and said weather protection means each comprise materials configured for ease of coupling to the conformation of said exposed surface.

6. The improvement of claim 5 wherein said exposed surface comprises the top surface of said casing of said evaporative cooler.

7. The improvement of claim 6 wherein said weather protection means comprises cap means configured to enclose said insulation means and said top surface of said casing.

8. The improvement of claim 7 further comprising means for fixedly coupling said cap means to said casing.

9. The improvement of claim 8 wherein said means for fixedly coupling said cap means to said casing comprises screw fastener means.

10. The improvement of claim 7 wherein said cap means comprises a moldable plastic material.

* * * * *